US005629721A

United States Patent [19]

Kirk

[11] Patent Number: 5,629,721

[45] Date of Patent: May 13, 1997

[54] GRAPHICS DISPLAY SYSTEM

[75] Inventor: Richard A. Kirk, Herts, England

[73] Assignee: Crosfield Electronics Limited, Herts, England

[21] Appl. No.: 218,234

[22] Filed: Mar. 28, 1994

Related U.S. Application Data

[63] Continuation of Ser. No. 684,095, Apr. 12, 1991, abandoned.

[30] Foreign Application Priority Data

Apr. 12, 1990 [GB] United Kingdom ..... 9008426

[51] Int. Cl.[6] ..... G09G 5/34

[52] U.S. Cl. ..... 345/123; 345/114

[58] Field of Search ..... 345/121, 123, 345/114, 115, 116; 348/584, 585, 586, 587, 590, 591, 592

[56] References Cited

U.S. PATENT DOCUMENTS

| | | | |
|---|---|---|---|
| 4,602,286 | 7/1986 | Kellar et al. | 358/183 |
| 4,682,297 | 7/1987 | Iwami | 340/721 |
| 4,908,700 | 3/1990 | Ishii et al. | 358/183 |
| 4,954,819 | 9/1990 | Watkins | 340/721 |

FOREIGN PATENT DOCUMENTS

| | | |
|---|---|---|
| 168144 | 1/1986 | European Pat. Off. . |
| 308506 | 3/1989 | European Pat. Off. . |
| 344976 | 12/1989 | European Pat. Off. . |
| 2208344 | 3/1989 | United Kingdom . |

OTHER PUBLICATIONS

Setrag Khoshafian, A. Brad Baker, Intelligent Offices Object—Oriented Multi-Media Information Management in Client/Server Achitectures, pp 305–325, Figure 9.15.

*Primary Examiner*—Mark R. Powell
*Assistant Examiner*—Matthew Luu
*Attorney, Agent, or Firm*—Sughrue, Mion, Zinn, Macpeak & Seas

[57] ABSTRACT

A graphics display system comprises a monitor (5); a first frame store (1) for holding digital data defining the color content of an image to be displayed on the monitor; a second frame store (2) for holding an array of control data, there being a control data value corresponding to each pixel of the image in the first frame store; and a processor (6,10,3) to cause the monitor to display the image in the first frame store under control of the control data array. The processor (6,10,3) means is adapted to cause a moving contrast image to be mixed with the image from the first frame store (1) under control of the control data array.

8 Claims, 1 Drawing Sheet

GRAPHICS DISPLAY SYSTEM

This is a Continuation of application Ser. No. 07/684,095 filed Apr. 12, 1991, now abandoned.

FIELD OF THE INVENTION

The invention relates to a graphics display system of the kind comprising a monitor; a first frame store for holding digital data defining the colour content of an image to be displayed on the monitor; a second frame store for holding an array of control data, there being a control data value corresponding to each pixel of the image in the first frame store; and processing means to cause the monitor to display the image in the first frame store under control of the control data array. Such systems are hereinafter referred to as of the kind described.

DESCRIPTION OF THE PRIOR ART

The use of a control data array or mask provides a very powerful tool in the field of graphics display systems. For example, it allows sections of an image to be defined differently from other sections of the image for separate processing, cut-out and the like. Masks can have a binary nature or be defined on a grey scale or a combination of the two. Masks can be produced by hand or using an algorithm such as a colour selective technique. In this latter technique, a set of colour component ranges is defined following which each pixel whose colour components fall within the defined ranges is coded differently from those pixels having colour components falling outside the ranges.

It is often desirable to demonstrate the effect of such masks on the monitor. In the past, this has been done by causing the monitor to display a special colour in the masked areas. However, using a flat colour for the whole image is not adequate since patches of the image itself could have the same colour. One attempt to deal with this has been to use "out of gamut" colours to display the masked pixels. These colours fall within the monitor gamut but outside the gamut of printable colours and so would not normally be expected to be present in an image to be printed. However, with grey scale masks conventional out of gamut colours, such as green, are not generally sufficient since when added to existing image colours to display the mask as a semi-transparent overlay they can appear to be in gamut.

One modification which has recently been proposed is to cause the mask colour to flash. However, even this can be difficult to see and in any event all operators agree that an image with flashing regions can be painful to look at.

SUMMARY OF THE INVENTION

In accordance with the present invention, a graphics display system of the kind described is characterized in that the processing means is adapted to cause a moving contrast image to be mixed with the image from the first frame store under control of the control data array.

In some cases the moving contrast image can be generated directly but in most cases the system further comprises a third frame store containing digital data defining the colour content of the contrast image, wherein the processing means causes the monitor to display the result of mixing the images from the first and third frame stores under the control of the control data array, and causes any portions of the image from the third frame store which are displayed to move relative to the display. The third frame store can be the same size as the first and second frame stores or could be smaller, for example holding one repeat of the contrast image.

We have developed a new method for viewing masked regions of an image which involves causing a contrast image to move or scroll across the masked regions. It has been found that this is not painful to the eye and is readily viewable even where a single, masked pixel exists within an area of unmasked pixels.

The contrast image can take a variety of forms but is preferably in the form of a repeating pattern, such as a set of parallel lines. Preferably, the lines extend at substantially 45° to the orthogonal axes of the monitor display.

The repeating pattern may be monochrome but is preferably coloured.

The scrolling motion is preferably at a constant rate although a variable rate is also possible. In the preferred example, the rate of scroll is such that an individual contrast image pixel scrolls from one image pixel to the next in about one second.

Although in the preferred examples coloured lines or stripes are used, other patterns such as text and the like could also be used.

The framestores may be physically separate or formed by different sections of the same memory.

BRIEF DESCRIPTION OF THE DRAWING

An example of a graphics display system according to the invention will now be described with reference to the accompanying block diagram of the apparatus (FIG. 1).

DETAILED DESCRIPTION OF AN EMBODIMENT

Figure 1:
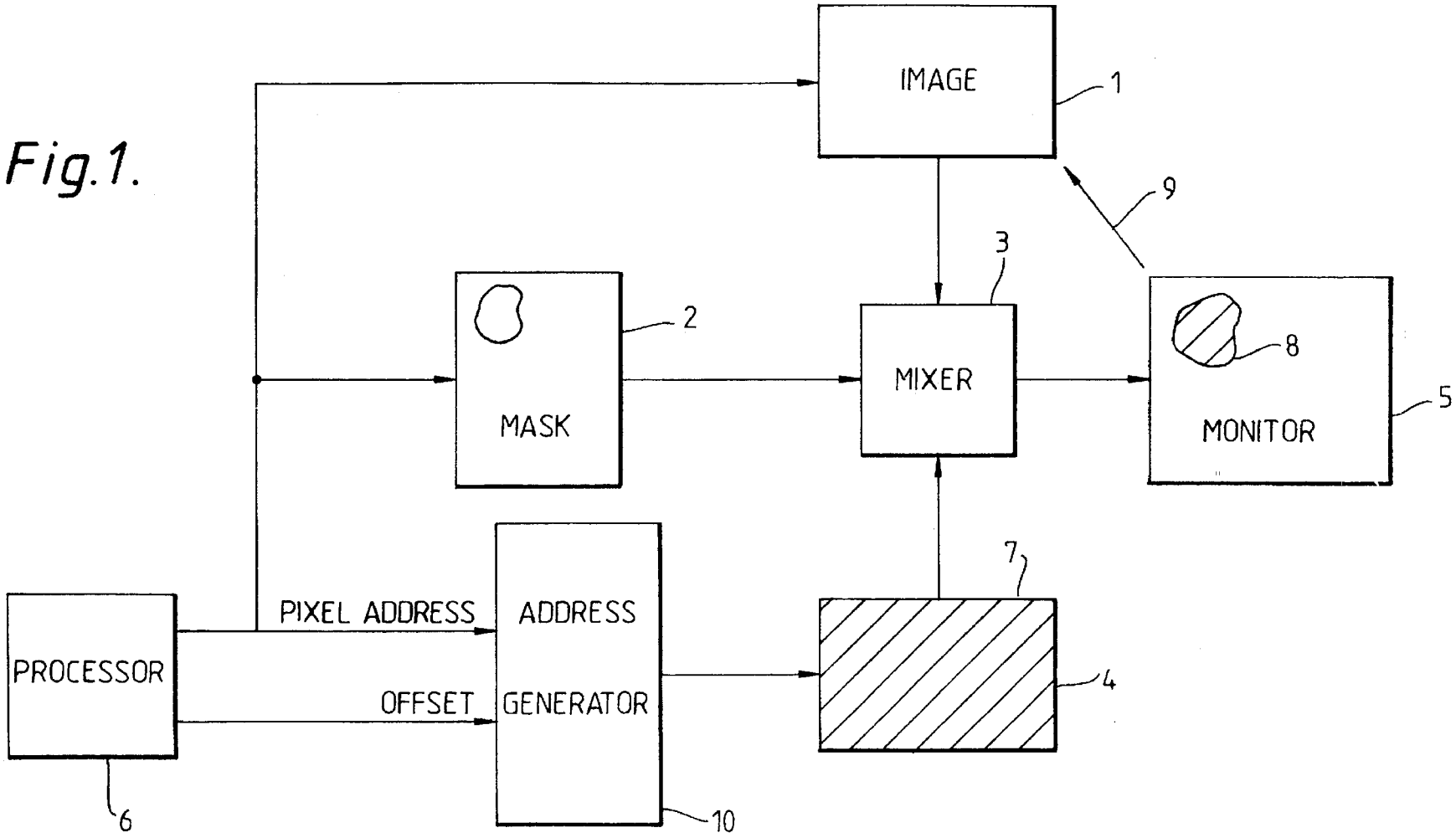

The apparatus shown in the drawing comprises an image frame store 1 which contains digital data defining the colour component content of an image, for example in terms of red, green, and blue colour components. A mask frame store 2 is provided for storing binary mask control data, the stores 1, 2 being connected to a mixer unit 3. A contrast image frame store 4 is also connected to the mixer unit 3. In this example frame store 4 is the same size as frame stores 1 and 2 but a smaller frame store could be used as mentioned above. The output from the mixer unit 3 is connected to a display monitor 5.

A processor 6, such as a microcomputer, is used to generate the display on the monitor 5. This display results from a combination of the image in the store 1 with the contrast image in the store 4 under the control of the mask data in the store 2. This is a conventional masking operation and the mixer unit 3 may have a form similar to that described in EP-A-0344976. In this case of a binary mask, each displayed pixel will consist of either an image pixel from the store 1 or a contrast image pixel from the store 4.

As can be seen in the drawing, the contrast image comprises a set of stripes 7 so that in a masked region 8 of the monitor display the contrast image will appear, as shown whereas in the remainder of the display the image in the store 1 will appear.

However, instead of a conventional static display, the processor 6 arranges for the contrast image in the store 4 to scroll with a period of about one second in the direction of an arrow 9 so as to make the masked regions more clearly visible to the operator. The processor 6 generates a pixel address at a rate corresponding to the raster display rate of the monitor 5, this pixel address being fed to the image and mask stores 1, 2. In addition, the pixel address is fed to an address generator 10 connected to the contrast store 4 so that the correct, corresponding information is accessed from the stores 1, 2, 4 for each pixel displayed on the monitor 5. To achieve scrolling, an additional, off-set value is generated by the processor 6, this off-set value changing with a period of about one second which the address generator 10 then takes into account when locating the pixel in the store 4 which contains the information to be displayed the masked region 8.

It has been found that on a 512×512 monitor, a stripe width of 8 pixels (i.e. a repeat of 16 pixels) moving with a period of about 1 second is particularly useful.

It should be appreciated that the invention is not only applicable to binary masks as described above but can be applied to grey level masks and soft-edged masks.

I claim:

1. A graphics display system comprising a monitor; a first frame store for holding digital data defining the colour content of an underlying image to be displayed on said monitor; a second frame store for holding an array of control data, there being a control data value corresponding to each pixel of the underlying image in said first frame store; and processing means to cause said monitor to display the underlying image in said first frame store under control of the control data array, wherein said processing means is adapted to cause a second image, having contrast image data that is scrolled continuously within it, to be mixed with the underlying image under control of the values in the control data array so as to distinguish said second image from said underlying image.

2. A system according to claim 1, further comprising a third frame store containing digital data defining the colour content of said second image having contrast image data that is scrolled within it, wherein said processing means causes said monitor to display the result of mixing the images from the first and third frame stores under the control of the control data array, and causes any portions of the second image from said third frame store which are displayed to move relative to the display.

3. A system according to claim 1, wherein the second image having contrast image data that is scrolled within it comprises a repeating pattern.

4. A system according to claim 3, wherein the second image having contrast image data that is scrolled within it comprises a set of parallel lines.

5. A system according to claim 4, wherein the lines extend at substantially 45° to the orthogonal axes of the monitor display.

6. A system according to claim 1, wherein said processing means causes the second image having contrast image data that is scrolled within it to move at a substantially constant rate.

7. A system according to claim 6, wherein the rate of movement is such that an individual contrast image pixel moves from one image pixel to the next in about one second.

8. A system according to claim 1, wherein each of said fixed control data values has one of two binary values.

* * * * *